US007163202B2

(12) United States Patent
Togashi et al.

(10) Patent No.: US 7,163,202 B2
(45) Date of Patent: Jan. 16, 2007

(54) SHEET FEEDING DEVICE AND IMAGE FORMING APPARATUS COMPRISING THE SHEET FEEDING DEVICE

(75) Inventors: Toshifumi Togashi, Kanagawa (JP); Eiichi Hattori, Kyoto (JP)

(73) Assignees: Ricoh Company, Ltd., Tokyo (JP); Yamauchi Corporation, Hirakata (JP)

( * ) Notice: Subject to any disclaimer, the term of this patent is extended or adjusted under 35 U.S.C. 154(b) by 402 days.

(21) Appl. No.: 10/879,741

(22) Filed: Jun. 30, 2004

(65) Prior Publication Data

US 2005/0017431 A1 Jan. 27, 2005

(30) Foreign Application Priority Data

Jul. 1, 2003 (JP) ..... 2003-189854

(51) Int. Cl.
*B65H 3/52* (2006.01)

(52) U.S. Cl. ..... 271/121; 271/167; 492/56; 492/59

(58) Field of Classification Search ..... 271/121, 271/167; 492/56, 59
See application file for complete search history.

(56) References Cited

U.S. PATENT DOCUMENTS 4,815,724 A * 3/1989 Sumida et al. ..... 271/121
6,308,027 B1 10/2001 Obu et al.
6,542,707 B1 4/2003 Muramatsu et al.
6,597,883 B1 7/2003 Muramatsu et al.
6,674,982 B1 1/2004 Saitoh et al.
6,697,584 B1 2/2004 Tsunoda et al.
6,725,003 B1 4/2004 Shinkai et al.
6,757,515 B1 6/2004 Ueda
6,775,511 B1 8/2004 Kosuge
6,919,401 B1 * 7/2005 Mabuchi et al. ..... 524/500
6,948,710 B1 * 9/2005 Togashi et al. ..... 271/124
2002/0036377 A1 * 3/2002 Togashi ..... 271/127
2002/0160895 A1 * 10/2002 Yamaguchi et al. ..... 492/56
2006/0142132 A1 * 6/2006 Shiraki et al. ..... 492/56

FOREIGN PATENT DOCUMENTS

JP 2003-26348 1/2003

* cited by examiner

*Primary Examiner*—David H. Bollinger
(74) *Attorney, Agent, or Firm*—Oblon, Spivak, McClelland, Maier & Neustadt, P.C.

(57) ABSTRACT

A sheet feeding device comprises a sheet feeding member having an outer layer thereof, a sheet loaded on a sheet loading member being depressed on a peripheral surface of the outer layer, the sheet feeding member delivering the sheet depressed to the peripheral surface, through rotation of the peripheral surface. An inclination member having a depression portion and an inclined surface, the depression portion depressing the sheet on the peripheral surface, and a leading edge of the sheet being brought in contact with the inclined surface. The outer layer of the sheet feeding member is formed of a cross-linked rubber material which has a JIS-A hardness in a range between 25 degrees and 40 degrees, a tearing strength measured with a JIS B-type specimen, which is 10 N/mm or more, and a viscoelastic characteristic expressed by a loss tangent, which is 0.045 or less.

7 Claims, 5 Drawing Sheets

SHEET FEEDING DEVICE AND IMAGE FORMING APPARATUS COMPRISING THE SHEET FEEDING DEVICE

BACKGROUND OF THE INVENTION

1. Field of the Invention

The present invention relates to a sheet feeding device, and an image forming apparatus comprising a sheet feeding device.

2. Description of the Related Art

Conventionally, various designs of sheet feeding device which separates one sheet from the loaded sheets and delivers the sheet are proposed and put in practical use. For example, a conventional sheet feeding device of widely used type includes a sheet feeding member and a friction pad, the friction pad being depressed on the peripheral surface of the sheet feeding member.

In the sheet feeding device of the above type, the uppermost sheet among the sheets loaded on the sheet loading member is depressed on the peripheral surface of the sheet feeding member, delivered through rotation of the sheet feeding member, and separated from the other loaded sheets when the uppermost sheet passes by between the sheet feeding member and the friction pad, so that only the uppermost sheet is delivered.

In order to separate the sheet one by one certainly, it is necessary for the sheet feeding device of the above type to set a coefficient of friction of the friction pad relative to the sheet at a sufficiently large value. However, when the coefficient of friction of the friction pad is enlarged in this way, the sheet which passes through the area between the friction pad and the sheet feeding member is subjected to stick slipping, and there is a possibility that abnormal noise takes place.

Japanese Laid-Open Patent Application No. 2003-026348 discloses a sheet feeding device which is adapted for resolving the above problem.

In the sheet feeding device disclosed in Japanese Laid-Open Patent Application No. 2003-026348, the sheet loading member, the sheet feeding member and the inclination member are provided. The sheet from the sheets loaded on the sheet loading member is depressed to the peripheral surface of the uppermost surface of the sheet feeding member. The sheet feeding member serves to deliver the sheet through rotation of the peripheral surface. The inclination member includes a depression portion and an inclined surface. The sheet is depressed to the peripheral surface of the uppermost layer of the sheet feeding member by the depression portion of the inclination member. The leading edge of the sheet delivered is brought into contact with the inclined surface of the inclination member.

According to the sheet feeding device of this type, it is not necessary to enlarge the coefficient of friction of the depression portion of the inclination member relative to the sheet as in the above-mentioned friction pad. The sheet is pinched by the depression portion of the inclination member and the sheet feeding member and delivered through rotation of the sheet feeding member. Thus, it is possible to prevent the occurrence of stick slipping and the occurrence of abnormal noise effectively.

However, consideration as to the characteristics of the uppermost surface of the sheet feeding member in the conventional device is not taken adequately. It is likely that the sheet feeding member comes to slip to the sheet at a comparatively early stage, and there is a possibility that the sheet feeding member is not capable of delivering the sheet correctly due to the slipping.

SUMMARY OF THE INVENTION

An object of the present invention is to provide an improved sheet feeding device in which the above-described problems are eliminated.

Another object of the present invention is to provide a sheet feeding device which is capable of delivering the sheet correctly while maintaining the sheet separation function over an extended period of time.

Another object of the present invention is to provide an image forming apparatus comprising a sheet feeding device which is capable of delivering the sheet correctly while maintaining the sheet separation function over an extended period of time.

The above-mentioned objects of the present invention are achieved by a sheet feeding device comprising: a sheet feeding member having an outer layer thereof, a sheet loaded on a sheet loading member being depressed on a peripheral surface of the outer layer of the sheet feeding member, the sheet feeding member delivering the sheet depressed to the peripheral surface, through rotation of the peripheral surface; and an inclination member having a depression portion and an inclined surface located at an upstream side of the depression portion in a sheet delivery direction, the depression portion depressing the sheet on the peripheral surface, a leading edge of the sheet being brought in contact with the inclined surface, the inclination member being supported movably in a direction to approach to or separate from the peripheral surface, an inclusion angle between the inclined surface of the inclination member and an outgoing direction of the sheet being set as an acute angle so that the leading edge of the sheet in contact with the inclined surface is guided through the inclined surface for delivery to the depression portion, and an inclusion angle between the depression portion and the inclined surface being set as being less than 180 degrees, wherein the outer layer of the sheet feeding member is formed of a cross-linked rubber material which has a JIS-A hardness in a range between 25 degrees and 40 degrees, a tearing strength measured with a JIS B-type specimen, which is 10 N/mm or more, and a viscoelastic characteristic expressed by a loss tangent, which is 0.045 or less.

The above-mentioned objects of the present invention are achieved by a sheet feeding device comprising: a sheet feeding member having an outer layer thereof, a sheet loaded on a sheet loading member being depressed on a peripheral surface of the outer layer of the sheet feeding member, the sheet feeding member delivering the sheet depressed to the peripheral surface, through rotation of the peripheral surface; and an inclination member having a depression portion and an inclined surface located at an upstream side of the depression portion in a sheet delivery direction, the depression portion depressing the sheet on the peripheral surface, a leading edge of the sheet being brought in contact with the inclined surface, the inclination member being supported movably in a direction to approach to or separate from the peripheral surface, an inclusion angle between the inclined surface of the inclination member and an outgoing direction of the sheet being set as an acute angle so that the leading edge of the sheet in contact with the inclined surface is guided through the inclined surface for delivery to the depression portion, and an inclusion angle between the depression portion and the inclined surface being set as being less than 180 degrees, wherein the outer layer of the sheet feeding member is formed of a cross-linked rubber material which has a JIS-A hardness in a range between 25 degrees and 40 degrees, a tearing strength measured with a JIS B-type specimen, which is 10 N/mm or more, and an impact resilience which is 73% or more.

The above-mentioned objects of the present invention are achieved by an image forming apparatus comprising a sheet feeding device and an imaging unit form an image on a sheet delivered by the sheet feeding device, the sheet feeding device comprising: a sheet feeding member having an outer layer thereof, a sheet loaded on a sheet loading member being depressed on a peripheral surface of the outer layer of the sheet feeding member, the sheet feeding member delivering the sheet depressed to the peripheral surface, through rotation of the peripheral surface; and an inclination member having a depression portion and an inclined surface located at an upstream side of the depression portion in a sheet delivery direction, the depression portion depressing the sheet on the peripheral surface, a leading edge of the sheet being brought in contact with the inclined surface, the inclination member being supported movably in a direction to approach to or separate from the peripheral surface, an inclusion angle between the inclined surface of the inclination member and an outgoing direction of the sheet being set as an acute angle so that the leading edge of the sheet in contact with the inclined surface is guided through the inclined surface for delivery to the depression portion, and an inclusion angle between the depression portion and the inclined surface being set as being less than 180 degrees, wherein the outer layer of the sheet feeding member is formed of a cross-linked rubber material which has a JIS-A hardness in a range between 25 degrees and 40 degrees, a tearing strength measured with a JIS B-type specimen, which is 10 N/mm or more, and a viscoelastic characteristic expressed by a loss tangent, which is 0.045 or less.

According to the sheet feeding device of the present invention, the sheet can be delivered correctly and the sheet separation function can be maintained over an extended period of time.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will now be given of the preferred embodiments of the invention with reference to the accompanying drawings.

Figure 1:
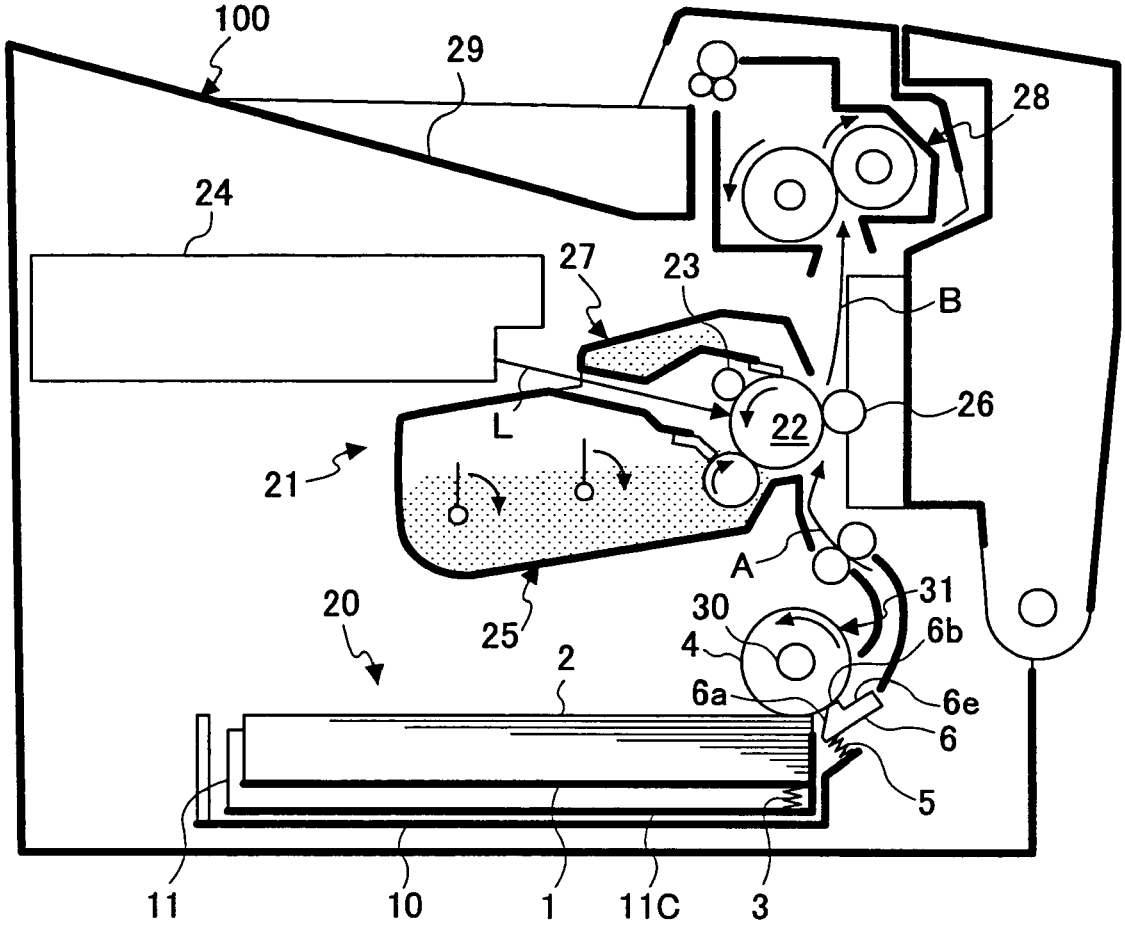
FIG. 1 is a cross-sectional view of an image forming apparatus in which the sheet feeding device of the invention is embodied.

FIG. 1 is a perpendicular cross-sectional view of an image forming apparatus which is constituted as a printer. In this image forming apparatus, the sheet feeding device of the invention is embodied.

The sheet feeding device 20 and an imaging unit 21 to form the image in the sheet 2 delivered from the sheet feeding device 20 are formed in the core of the image-forming-apparatus body 100.

First, the composition and the operation of the imaging unit 21 are explained.

The imaging unit 21 of this example has the drum-like photoconductor 22, and the rotation drive of this photoconductor 22 is carried out to the counterclockwise rotation in FIG. 1 at the time of image-formation operation.

At this time, the front face of the photoconductor 22 is charged in predetermined polarity with the electrification roller 23 which is an example of the charging device, the laser light L which acts to the front face of the electrified photoconductor 22 from the exposure device 24 and by which the optical modulation was carried out is irradiated, and the electrostatic latent image is formed in the photoconductor front face of this.

This electrostatic latent image is formed into the visible image by the developing device 25 as a toner image.

The photoconductor 22 countering the transfer the device an example it is the transfer the roller 26 configuring having the sheet the feed the device 20 from mentioning later the mode the arrow head A the direction feeding having had the sheet two the photoconductor 22 the transfer the roller 26 the between the transfer the part the passage this the time the transfer.

The transfer remaining toner which adhered on the photoconductor 22, without the sheet 2 transferring is removed by the cleaning device 27.

Moreover, the sheet 2 which passed the transfer part passes along the fixing device 28, as the arrow head B shows, and the sheet is fixed to the toner image on the sheet 2 in the operation of heat and pressure at this time. The sheet which passed the fixing device 28 is discharged by the delivery unit 29.

The predetermined image is formed in the sheet 2 delivered from the sheet feeding device 20 as mentioned above of the imaging unit 21.

Figure 2:
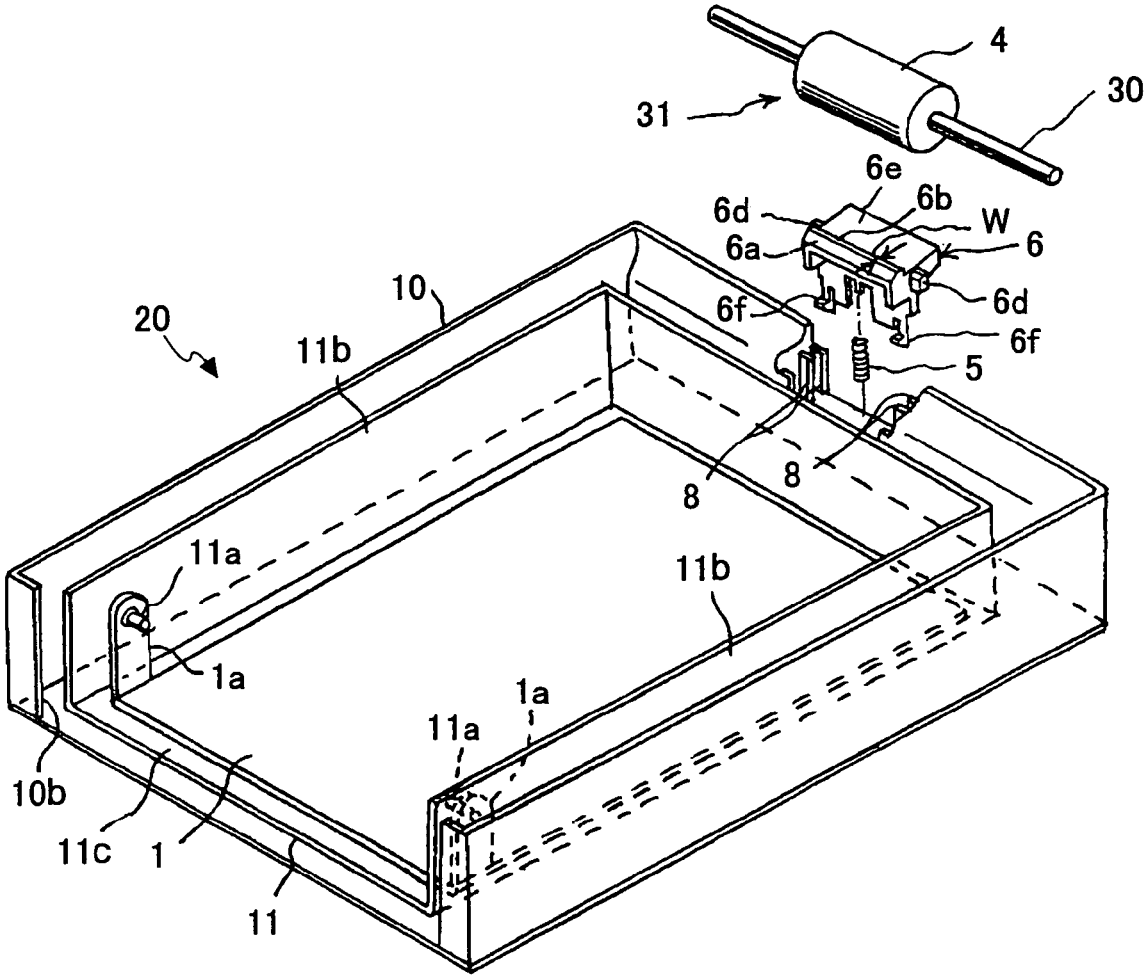
FIG. 2 is a perspective view of an embodiment of the sheet feeding device in which the sheet feeding member and the inclination member are detached from the body case.

The sheet feeding device 20 has the cassette 11 with which it was equipped free [the attachment and detachment ] in the body case 10 through opening 10*b* formed in the rear of the box-like the body case 10 where the upper part is opened wide and the body case 10, as shown in FIG. 1 and FIG. 2.

The sheet loading generally called the bottom plate in this cassette 11 the member 1 has been configured and the pore formed in lug part 1*a* which protruded on the back end side fits into pin 11*a* which protruded on each side-attachment-wall 11*b* of the cassette 11 rotatably.

Moreover, sheet loading between the leading edge of the member 1, and the bottom wall 11*c* of the cassette 11, as shown in FIG. 1, the compression spring 3 configures having this sheet loading the leading edge of the member 1 is energized towards the upper part.

Moreover, the sheet feeding device 20 sheet feed the member 31 having sheet feed of this example the member 31 is comprised as a feed roller which has the shaft 30 and the outer layer 4 which consists of the elastic body which has been configured in the shape of a said alignment, and was fixed to the shaft 30.

The shaft 30 is supported by the body case 10 or the image-forming-apparatus body 100 free [rotation ]. The sheet loading on the member 1, as shown in FIG. 1 and FIG. 3, the sheet 2 explained previously loads having sheet loading the member 1 is energized up by the compression spring 3.

Figure 3:
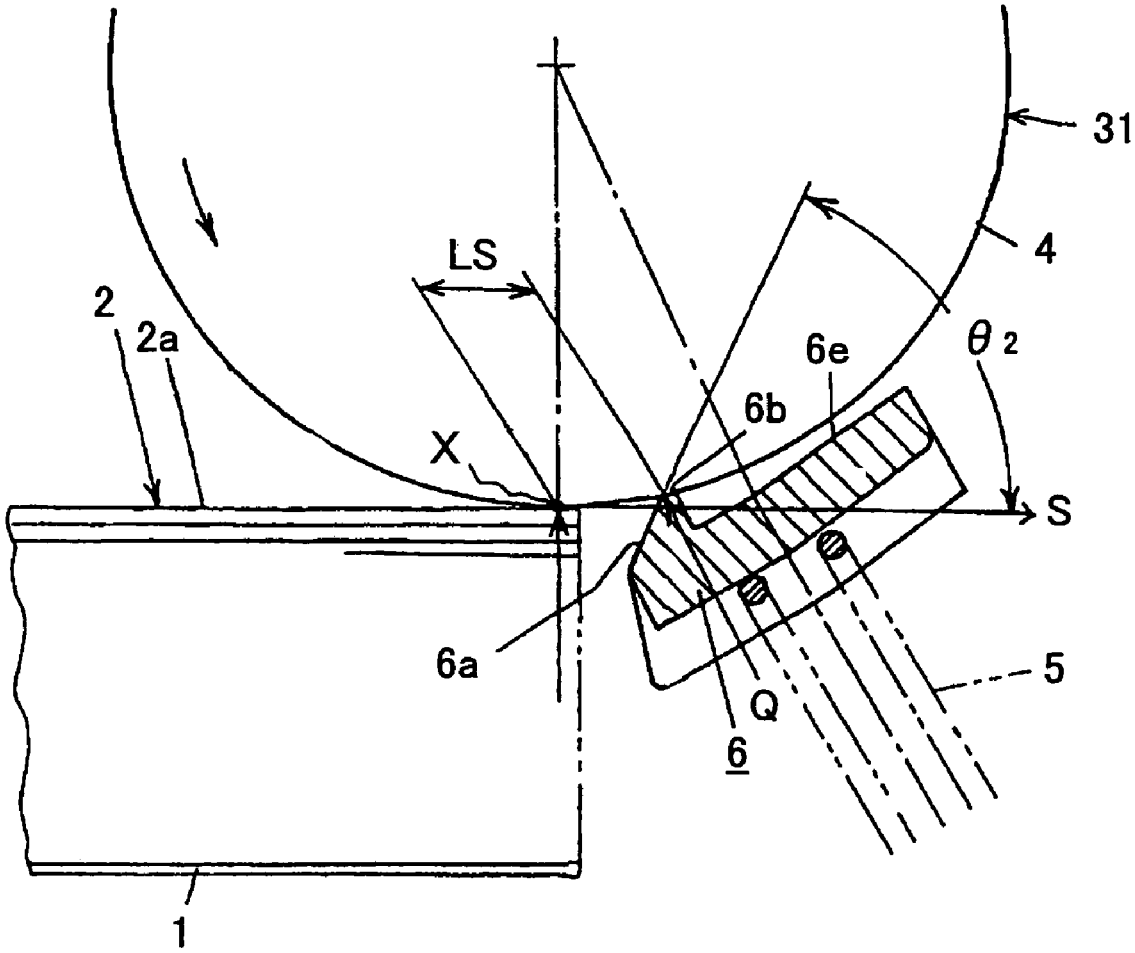
FIG. 3 is a diagram for explaining the positional relation of the sheet feeding member, the inclination member and the sheet.

As shown in FIG. 3, the leading edge X of the uppermost sheet 2*a* among the sheets 2 loaded on the sheet loading member 1 is depressed on the peripheral surface of the outer layer 4 of the sheet feeding member 31. Hereafter, this part is called the depression portion X.

Moreover, the sheet 2 of this example is comprised from paper or the resin sheet.

As is mentioned later, the sheet 2*a* sheet feed although delivered in the direction shown in FIG. 3 by the arrow head S when the member 31 rotated, the inclination member 6 which has inclined plane 6*a* is configured from the depression portion X at the downstream position in the sheet conveyance direction, the portion indicated by reference numeral 6*b* of this inclination member 6 where the energization action of the compression spring 5 performs depression to the peripheral surface of the outer layer 4 of the sheet feeding member 31. This portion will be called depression portion 6*b*.

Thus, the inclination member 6 includes the depression portion 6*b* which performs depression to the peripheral surface of the outer layer 4 of the member 31, and the portion by the upstream side of the sheet delivery direction comprises the inclined plane 6*a* extending from the depression portion 6*b*.

Moreover, as shown in FIGS. 2, 6*d* of projections which protruded on each side surface of the inclination member 6 fits into the guide rail 8 prepared in the body case 10 respectively free [sliding].

Thereby the inclination member 6 sheet feed the compression spring 5 which was supported possible the transfer in the direction to approach to or separate from the peripheral surface of the outer layer 4 of the member 31, i.e., the direction of approaching to or separating from the peripheral surface, and has usually been configured between the inclination member 6 and the body case 10 so that the depression portion 6*b* of the inclination member 6 performs depression to the peripheral surface of the outer layer 4 of the sheet feeding member 31.

Moreover, when hook 6*f* of the pair is prepared in the lower part of the inclination member 6 and these engage with the stop part (not shown) of the body case 10, it is prevented that the inclination member 6 transfers up and secedes from the body case 10 rather than the maximum rise position.

As is apparent from FIG. 2, the depression portion 6*b* of the inclination member 6 extends in the direction of the axis of the sheet feeding member 31 including the feed roller, and the width W thereof becomes narrow. The portion 6*e* of the inclination member 6, which is located at the downstream side of the depression portion 6*b* in the outgoing direction of the sheet, separates from the peripheral surface of the outer layer 4 of the member 31.

Alternatively, the depression portion 6*b* may be divided into the plurality of parts in the outgoing direction S of the sheet 2*a* so that such depression portions 6*b* can be depressed onto the peripheral surface of the outer layer 4 of the sheet feeding member 31.

Moreover, as shown in FIG. 3, the distance LS along the outgoing direction S of the sheet between the depression portion X where the sheet 2 loaded on the sheet loading member 1 is depressed to the peripheral surface of the outer layer 4 of the sheet feeding member 31, and the depression portion 6*b* of the inclination member 6 depressed to the peripheral surface of the outer layer 4 of the member 31 is set to be a short distance ranging from 2 mm to 6 mm.

Furthermore, it is assumed that the coefficient of friction of the peripheral surface of the outer layer 4 relative to the sheet 2 is $\mu 1$, the coefficient of friction of the sheet 2 to the sheet 2 is $\mu 2$, and the coefficient of friction of the depression portion 6*b* of the inclination member 6 relative to the sheet 2 is $\mu 3$. The sheet feeding device is provided so that the conditions: $\mu 1>\mu 2>\mu 3$ are met. If the inclination member 6 is formed of a resin material, the coefficient of friction of the inclination member 6 relative to the sheet can be lowered certainly.

When the sheet feed signal is outputted from the control unit (not illustrated), the sheet feeding motor (not illustrated) starts rotation, and the shaft 30 and the sheet feeding member 31 fixed to the shaft 30 and including the outer layer 4 are rotated in the counterclockwise direction in FIG. 1 and FIG. 3.

The peripheral surface of the outer layer 4 transfers by this, and it pressurizes with the compression spring 3 so that the uppermost sheet 2*a* is depressed to the peripheral surface of the outer layer 4 of the member 31 and delivered in the direction of the arrow S indicated in FIG. 3 with the frictional force received from the peripheral surface of the outer layer 4.

Thus, sheet feed the member 31 the peripheral surface of the outer layer 4 sheet loading the business which sends out sheet 2*a* depressed to the sheet 2 loaded into the member 1, and depressed to the peripheral surface concerned by the transfer of this peripheral surface is made.

Figure 4:
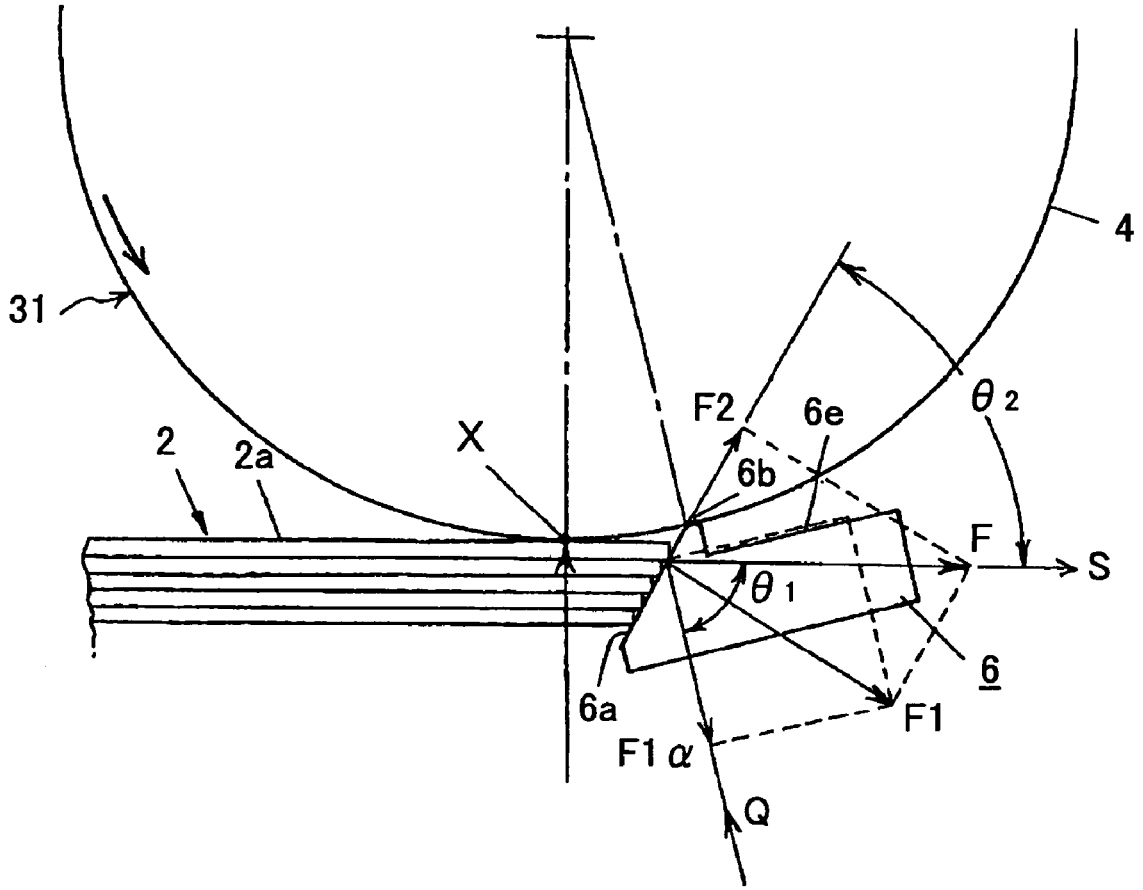
FIG. 4 is a diagram for explaining the condition of the sheet feeding device in which the edge of the uppermost sheet contacts the inclined surface of the inclination member and an external force is exerted on the inclined surface with the sheet edge.

Subsequently, as the delivered sheet 2*a* is shown in FIG. 4, the leading edge runs against inclined plane 6*a* of the inclination member 6. At this time, as shown in FIG. 4, the inclusion angle $\theta 2$ between the inclined plane 6*a* of the inclination member 6 and the outgoing direction S of the sheet is set as an acute angle so that the leading edge of the sheet 2*a* contacting the inclined plane 6*a* may be transferred to the depression portion 6*b* with the assistance of the inclinded plane 6*a*. It is prefereable that the inclusion angle $\theta 2$ is in a range of 50 degrees and 70 degrees.

Figure 6:
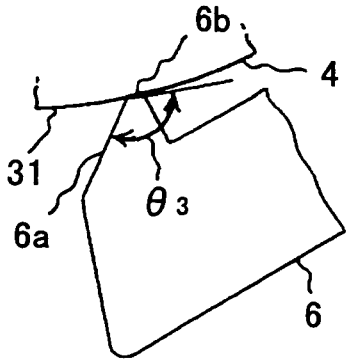
FIG. 6 is a diagram for explaining the angle which the inclined surface of the inclination member forms with the depression portion.

Moreover, as shown in FIG. 6, the inclusion angle $\theta 3$ between the depression portion 6*b* and the inclined plane 6*a* of the inclination member 6 is set to be less than 180 degrees.

Figure 5:
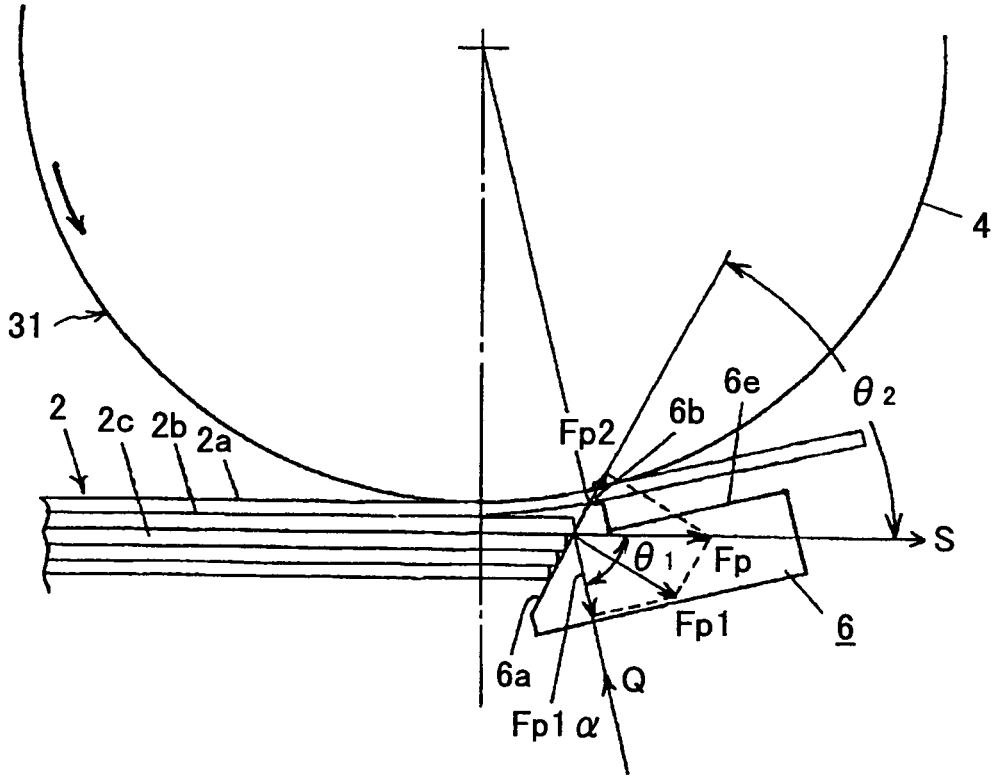
FIG. 5 is a diagram for explaining the condition of the sheet feeding device in which the edge of the next sheet contacts the inclined surface of the inclination member and an external force is exerted on the inclined surface with the sheet edge.

The sheet 2*a* guided as mentioned above at the depression portion 6*b* is shown in FIG. 5 as it passes along between this peripheral surface and depression portion 6*b* of the inclination member 6, receiving frictional force from the peripheral surface of the outer layer 4 of the member 31.

The distance equivalent to the thickness of sheet 2*a* the inclination member 6 it estranges from the peripheral surface of the outer layer 4 of the member 31, and sheet 2*a* conveyed in response to frictional force from the peripheral surface of the outer layer 4 passes through this.

At this time, since the respective coefficients of friction $\mu 1$,$\mu 2$ and $\mu 3$ are set to meet the conditions: $\mu 1>\mu 2>\mu 3$ as mentioned above, the uppermost sheet 2*a* with the frictional force received from the peripheral surface of the sheet feeding member 31 is readily delivered from the cassette 11 and passes through the depression portion 6*b*.

Subsequently, as this sheet 2*a* was previously explained with reference to FIG. 1, it is conveyed by the transfer part between the photoconductor 22 and the transfer roller 26, and the toner image on the photoconductor 22 is transferred on the sheet 2*a* at this time.

According to the sheet feeding device 20 mentioned above, the uppermost sheet 2*a* among the sheets 2 loaded on the sheet loading member 1 can be separated from the other sheets, and only the uppermost sheet 2*a* can be delivered.

Next, a description will be given of the operation at this time with reference to FIG. 4 and FIG. 5.

As shown in FIG. 4, when the leading edge of the uppermost sheet 2*a* contacts the inclined plane 6*a* of the inclination member 6, the force which the sheet 2*a* exerts on the inclined plane 6*a* is set to F, and the component of this force F in the direction perpendicular to the inclined plane 6*a* is set to F1, and the component of the force F in the direction parallel to the inclined plane 6*a* is set to F2.

Moreover, the force of the compression spring 5 to depress the inclination member 6 onto the peripheral surface of the sheet feeding member 31 is called the separation pressure Q, and the operating direction of this separation pressure Q forms the inclusion angle indicated by θ1, relative to the outgoing direction of the sheet 2*a*.

Then, by setting up the separation pressure Q to be smaller than the component F1alpha of the component force F1 in the operating direction of the separation pressure Q, the depression portion 6*b* of the inclination member 6 is separated from the peripheral surface of the outer layer 4 of the sheet feeding member 31 by the distance which is mostly equivalent to the thickness of the sheet 2*a* as shown in FIG. 5, and the sheet 2*a* passes through this space.

On the other hand, when the following sheet 2*b* which contacts the uppermost sheet 2*a* as shown in FIG. 5 is delivered together with the sheet 2*a* with the frictional force received from the uppermost sheet 2*a*, the leading edge of the sheet 2*b* runs against the inclined plane 6*a* of the inclination member 6, and the force Fp is applied to the inclined plane 6*a*.

This force Fp is also divided into the partial output Fp1 of the direction perpendicular to inclined plane 6*a* of the inclination member 6, and the partial output Fp2 of the direction in alignment with inclined plane 6*a*, and produces the component Fp1alpha of separation pressure Q and the reverse sense.

However, the frictional force which generally acts between the sheets small, it is about 50% which acts between the peripheral surface of the member 4, and sheet 2*a* of frictional force.

For this reason, the thickness of the uppermost sheet 2*a* whose inclination member 6 the force Fp1alpha also becomes the very small thing, and it can prevent estranging from the peripheral surface of the outer layer 4 of the member 31.

For this reason, the following sheet 2*b* is stopped by the inclined plane 6*a*, and it is not fed with this from the depression portion 6*a*.

The following sheet 2*b* downward sheet 2*c* it is the same, when is delivered together and these run against the inclined plane.

As mentioned above, the sheet feeding device 20 can deliver only the uppermost sheet 2*a* among the loaded sheets 2.

And, the coefficient of friction of the depression portion 6*b* of the inclination member 6 relative to the sheet 2*a* can be made small, and the occurrence of stick slipping of the sheet being conveyed between the peripheral surfaces of the sheet feeding member 31 can be prevented, and the occurrence of abnormal noise can be prevented effectively.

In the sheet feeding device of this embodiment, the outer layer 4 of the sheet feeding member 31 is formed of the following materials, and it can continue over an extended period of time, can send out the sheet correctly, and can raise the durability.

Namely, the outer layer 4 of the sheet feeding member 31 is formed of a cross-linked rubber material which has a tearing strength measured with a B-type specimen according to JIS (Japanese Industiral Standard) which is 10 N/mm or more, a JIS-A hardness which is in a range between 25 degrees and 40 degrees, and a viscoelastic-characteristic "tan δ" (expressed by a loss tangent) which is 0.045 or less.

Generally, the coefficient of friction of the outer layer 4 of the sheet feeding member 31 relative to the sheet 2 becomes large when the hardness of the outer layer 4 is low. However, if this hardness becomes too low, the antiwear quality of the outer layer 4 will fall. Then, the sheet feeding device 20 of this embodiment is configured such that the outer layer 4 of the sheet feeding member 31 is formed of a cross-linked rubber material which has a tearing strength measured with a JIS B-type specimen which is 10 N/mm or more, a JIS-A hardness which is in a range between 25 degrees and 40 degrees, and a viscoelastic-characteristic "tan δ" (expressed by a loss tangent) which is 0.045 or less. Therefore, the large coefficient of friction of the outer layer 4 of the sheet feeding member 31 relative to the sheet can be secured, and the deterioration of the durability can be prevented.

If the JIS A hardness of the outer layer 4 of the sheet feeding member 31 becomes higher than 40 degrees, there is a possibility that the coefficient of friction of the outer layer 4 of the member 31 relative to the sheet may become inadequate early, the sheet may slip to the peripheral surface of the outer layer 4 at the time of the feeding of the sheet, and the non-feeding of the sheet may occur. This problem can be prevented by setting the JIS A hardness of the layer 4 as being 40 degrees or less.

Moreover, if the JIS A hardness of the outer layer 4 of the sheet feeding member 31 is less than 25 degrees, the coefficient of friction of the outer layer 4 relative to the sheet becomes high so that the antiwear quality of the outer layer 4 deteriorates. This problem can be prevented by setting the JIS A hardness of the outer layer 4 of the sheet feeding member 31 as being 25 degrees or more.

On the other hand, when the value of viscoelastic-characteristic "tan δ" (loss tangent) of the outer layer 4 of the sheet feeding member 31 was large and the outer layer 4 carries out the compression set by repeating feed operation of the sheet repeatedly, the heating value generated on the outer layer 4 increases, and the antiwear quality of the outer layer 4 deteriorates, setting the viscoelastic-characteristic "tan δ" to 0.045 or less enables the high antiwear quality of the outer layer 4 of the sheet feeding member 31 to be maintained.

The measurement conditions of viscoelastic-characteristic "tan δ" will be explained later.

Moreover, the durability of the outer layer 4 can be raised by setting up the tearing strength of the outer layer 4 of the member 31 in 10 N/mm or more, the tearing strength of the outer layer 4 measured with the specimen of B form is less than 10 N/mm, although there is a possibility that the outer layer 4 may be missing with the external force applied to this while the antiwear quality of the outer layer 4 deteriorates at the time of use of the sheet feeding member 31 by setting up the tearing strength of the outer layer 4 of the member 31 in 10 N/mm or more, it can continue and the occurrence of this problem can be prevented over an extended period of time.

The sheet feed of composition of having mentioned above sheet feed of as opposed to after feeding the paper to the 180000 sheets 2 which consist of paper with the sheet feeding device 20 using the member 31 the sheet it is confirmed by the experiment that the non-feed of the sheet resulting from the slip of the outer layer 4 of the member 31 does not occur.

Next, the value of viscoelastic-characteristic "tan δ" is measured using the viscoelasticity measuring instrument of Iwamoto Industry Co. in Japan according to the following conditions:

the sample used: width 5 mm; length 30 mm; thickness 2 mm; initial distortion 4 mm, the amplitude is 0.1 mm, the frequency is 10 Hz, and the temperature is 30 deg. C.

Moreover, also constituting the outer layer 4 of the sheet feeding member 31 by a cross-linked rubber material whose tearing strength measured with a JIS B type specimen is 10 N/mm or more, the JIS A hardness is in a range of 25 degrees and 40 degrees, and the impact resilience is 73% or more, makes it possible to obtain the same effectiveness as that of the case where the above-mentioned sheet feeding member 31 is used. If the impact resilience of the outer layer 4 of the member 31 is 73% or more, similar to the case where the viscoelastic-characteristic is 0.045 or less, the high antiwear quality and high coefficient of friction of the outer layer 4 can be maintained.

Moreover, it can be secured that each characteristics mentioned above if what makes ethylene propylene diene copolymerization rubber the principal member is used as a material which constitutes the outer layer 4 of the sheet feeding member 31 since this material is cheap the advantage which can reduce the cost of the sheet feeding member 31 is acquired and, moreover, weather resistance can also be raised.

Furthermore, it is desirable that the 95% of the weight or more of the polymer ingredients of the cross-linked rubber material is ethylene propylene diene copolymerization rubber, and it is desirable that the polymer ingredients is especially 100% ethylene propylene diene copolymerization rubber.

Furthermore, if what constructed the bridge with the sulfur as a material which constitutes the outer layer 4 of the sheet feeding member 31 in the rubber composite which makes ethylene propylene diene copolymerization rubber the principal member is used, the antiwear quality of the outer layer 4 can be raised more.

It is advantageous in that case that the amount of sulfur combination to the rubber ingredients 100 weight part is below 4 weight parts more than 3 weight parts preferably below 5 weight parts more than 1.5 weight part.

If the crosslinking density is low in the amount of sulfur combination being under 1.5 weight part, the antiwear quality is inferior and this amount of combination exceeds 5 weight parts conversely sheet feed although there is a possibility that the compression-set characteristics of the outer layer 4 of the member 31 fall, the sulphuric bloom may happen and the coefficient of friction of the outer layer 4 to the sheet may fall.

The occurrence of such problem can be prevented for the amount of sulfur combination 1.5 or 5 weight parts, and by setting it as 3 or 4 weight parts especially.

Moreover, when ethylene propylene diene copolymerization rubber is used as a spring material which constitutes the outer layer 4 of the sheet feeding member 31, in order to make the JIS A hardness into 25 degrees or 40 degrees, it is desirable to blend the oil with the rubber concerned.

It is the rubber ingredients 10 in that case. It is desirable to make the amount of oil combination to 0 weight part into 75 weight parts or 150 weight parts.

If it becomes difficult to carry out JIS A hardness of the outer layer 4 to the amount of oil combination being under 75 weight parts at 25 degrees or 40 degrees and the amount of oil combination exceeds 150 weight parts, while soiling the sheet, and originating in this further, the paper chip adhering to the outer layer 4 and the coefficient's of friction falling with oil bleeding, the antiwear quality also deteriorates.

Moreover, although it is also advantageous to blend the reinforcement nature bulking agent which changes from the silica to ethylene propylene diene copolymerization rubber, it is desirable in that case to carry out the amount of combination of the reinforcement nature bulking agent to the rubber ingredients 100 weight part to more than 10 weight parts.

Thereby the mechanical hardness of the outer layer 4 of the sheet feeding member 31 is increased, the antiwear quality is raised, and the crack at the time of use with the system and manufacture and the occurrence of the chip can be prevented.

And even if it raises the oil and the amount of combination of the cross linking agent, by the absorption of the reinforcement nature bulking agent, especially the silica, bleeding and the bloom can be inhibited and coefficient-of-friction retention nature can be raised.

In the above-described sheet feeding device, although the feed roller was used as a sheet feeding member, it can replace with this roller and the sheet feeding member which consists of the endless belt by which winds around two or more rollers, is hung, and the rotation drive is carried out can also be used.

Although the endless belt of the lamina or the double layer can be used in that case, in the case of the endless belt of the lamina, the layer constitutes the surface.

Moreover, the present invention can be applied also to the image forming apparatus of the various forms other than the format shown in FIG. 1, or its sheet feeding device, and can be widely applied also to the image forming apparatus which consists of the image forming apparatus which has two or more sheet feeding devices which held the sheet of the size which is different, respectively, the copier, the facsimile, the duplicator or the compound machine, etc., or its sheet feeding device.

The present invention is not limited to the above-described embodiments, and variations and modifications may be made without departing from the scope of the present invention.

Further, the present application is based on Japanese priority application No. 2003-189854, filed on Jul. 1, 2003, the entire contents of which are hereby incorporated by reference.

What is claimed is:

1. A sheet feeding device comprising:

a sheet feeding member having an outer layer thereof, a sheet loaded on a sheet loading member being depressed on a peripheral surface of the outer layer of the sheet feeding member, the sheet feeding member delivering the sheet depressed to the peripheral surface, through rotation of the peripheral surface; and an inclination member having a depression portion and an inclined surface located at an upstream side of the depression portion in a sheet delivery direction, the depression portion depressing the sheet on the peripheral surface, a leading edge of the sheet being brought in contact with the inclined surface, the inclination member being supported movably in a direction to approach to or separate from the peripheral surface, an inclusion angle between the inclined surface of the inclination member and an outgoing direction of the sheet being set as an acute angle so that the leading edge of the sheet in contact with the inclined surface is guided through the inclined surface for delivery to the depression portion, and an inclusion angle between the depression portion and the inclined surface being set as being less than 180 degrees, wherein the outer layer of the sheet feeding member is formed of a cross-linked rubber material which has a JIS-A hardness in a range between 25 degrees and 40 degrees, a tearing strength measured with a JIS B-type specimen, which is 10 N/mm or more, and a viscoelastic characteristic expressed by a loss tangent, which is 0.045 or less.

2. A sheet feeding device comprising:

a sheet feeding member having an outer layer thereof, a sheet loaded on a sheet loading member being depressed on a peripheral surface of the outer layer of the sheet feeding member, the sheet feeding member delivering the sheet depressed to the peripheral surface, through rotation of the peripheral surface; and an inclination member having a depression portion and an inclined surface located at an upstream side of the depression portion in a sheet delivery direction, the depression portion depressing the sheet on the peripheral surface, a leading edge of the sheet being brought in contact with the inclined surface, the inclination member being supported movably in a direction to approach to or separate from the peripheral surface, an inclusion angle between the inclined surface of the inclination member and an outgoing direction of the sheet being set as an acute angle so that the leading edge of the sheet in contact with the inclined surface is guided through the inclined surface for delivery to the depression portion, and an inclusion angle between the depression portion and the inclined surface being set as being less than 180 degrees, wherein the outer layer of the sheet feeding member is formed of a cross-linked rubber material which has a JIS-A hardness in a range between 25 degrees and 40 degrees, a tearing strength measured with a JIS B-type specimen, which is 10 N/mm or more, and an impact resilience which is 73% or more.

3. The sheet feeding device according to claim 1 wherein the outer layer of the sheet feeding member contains ethylene propylene diene copolymerization rubber as a principal component.

4. The sheet feeding device according to claim 1 wherein the outer layer of the sheet feeding member is formed of the cross-linked rubber material in which rubber ingredients containing ethylene propylene diene copolymerization rubber as a principal component are cross linked with sulfur.

5. The sheet feeding device according to claim 4 wherein a content of the sulfur relative to 100 weight parts of the rubber ingredients is less than 5 weight parts and more than 1.5 weight parts.

6. The sheet feeding device according to claim 4 wherein a content of the sulfur relative to 100 weight parts of the rubber ingredients is less than 4 weight parts and more than 3 weight parts.

7. An image forming apparatus comprising a sheet feeding device and an imaging unit form an image on a sheet delivered by the sheet feeding device, the sheet feeding device comprising:

a sheet feeding member having an outer layer thereof, a sheet loaded on a sheet loading member being depressed on a peripheral surface of the outer layer of the sheet feeding member, the sheet feeding member delivering the sheet depressed to the peripheral surface, through rotation of the peripheral surface; and an inclination member having a depression portion and an inclined surface located at an upstream side of the depression portion in a sheet delivery direction, the depression portion depressing the sheet on the peripheral surface, a leading edge of the sheet being brought in contact with the inclined surface, the inclination member being supported movably in a direction to approach to or separate from the peripheral surface, an inclusion angle between the inclined surface of the inclination member and an outgoing direction of the sheet being set as an acute angle so that the leading edge of the sheet in contact with the inclined surface is guided through the inclined surface for delivery to the depression portion, and an inclusion angle between the depression portion and the inclined surface being set as being less than 180 degrees, wherein the outer layer of the sheet feeding member is formed of a cross-linked rubber material which has a JIS-A hardness in a range between 25 degrees and 40 degrees, a tearing strength measured with a JIS B-type specimen, which is 10 N/mm or more, and a viscoelastic characteristic expressed by a loss tangent, which is 0.045 or less.

* * * * *